US008003906B2

(12) United States Patent
Ebeling et al.

(10) Patent No.: US 8,003,906 B2
(45) Date of Patent: Aug. 23, 2011

(54) CROSSBAR DEVICE CONSTRUCTED WITH MEMS SWITCHES

(75) Inventors: Carl Ebeling, Redwood City, CA (US); Frederic Reblewski, Paris (FR); Olivier V. Lepape, Paris (FR); Jean Barbier, Montpellier (FR)

(73) Assignee: Meta Systems, Meudon la Forêt (FR)

( * ) Notice: Subject to any disclaimer, the term of this patent is extended or adjusted under 35 U.S.C. 154(b) by 311 days.

(21) Appl. No.: 12/263,223

(22) Filed: Oct. 31, 2008

(65) Prior Publication Data

US 2010/0108479 A1 May 6, 2010

(51) Int. Cl.
*H01H 57/00* (2006.01)

(52) U.S. Cl. ..... 200/181; 335/78

(58) Field of Classification Search ..... 200/181; 335/78

See application file for complete search history.

(56) References Cited

U.S. PATENT DOCUMENTS 5,497,369 A * 3/1996 Wainwright ..... 370/390
5,687,324 A * 11/1997 Green et al. ..... 370/414
6,556,739 B1 * 4/2003 Kruglick ..... 385/17
2002/0021859 A1 * 2/2002 Briggs ..... 385/17
2006/0056128 A1 * 3/2006 Cranford et al. ..... 361/207
2008/0091961 A1 * 4/2008 Cranford et al. ..... 713/300
2008/0291938 A1 * 11/2008 Eckstein et al. ..... 370/437
2009/0134522 A1 * 5/2009 Smith et al. ..... 257/769
2009/0207717 A1 * 8/2009 van Kampen ..... 369/126
2009/0273971 A1 * 11/2009 Schepens ..... 365/166

* cited by examiner

*Primary Examiner* — Michael A Friedhofer
(74) *Attorney, Agent, or Firm* — Dickstein Shapiro LLP

(57) ABSTRACT

Embodiments of crossbar devices constructed with Micro-Electro-Mechanical Systems (MEMS) switches are disclosed herein. A crossbar device may comprise m input terminals, n output terminals, n control lines and m×n MEMS switches coupled to the n control lines to selectively couple the m input terminals to the n output terminal. Each of the MEMS switches may comprise a contact node coupled to one of the m input terminals, a cantilever coupled to one of the n output terminals, a control node coupled to one of the n control lines to electrostatically control the cantilever to contact the contact node or be away from the contact node using electrostatic attractive or repulsive force respectively. The cantilever and the contact node are configured to remain in contact by molecular adhesion force, after the cantilever has been electrostatically controlled to contact the contact node, and the electrostatic attractive force has been removed. Other embodiments may be described and claimed.

18 Claims, 7 Drawing Sheets

CROSSBAR DEVICE CONSTRUCTED WITH MEMS SWITCHES

TECHNICAL FIELD

The present invention relates to the fields of integrated circuit (IC) and Mirco-Electro-Mechanical Systems (MEMS). More specifically, the present invention relates to crossbar devices constructed with MEMS features, and their usage in reconfigurable circuits.

BACKGROUND

A crossbar device is a circuit component used to make arbitrary connections between a set of inputs to a set of outputs. Crossbar devices are typically implemented using transistors. However, there may be several disadvantages of the transistor-based implementation of crossbar devices. One of the potential disadvantages is the effective resistance of the transistors, which is compounded when the transistors are coupled in series. Another potential disadvantage is the voltage drop over the transistors, which reduces the speed of the circuit and requires the output signals of the crossbar device to be restored. In the context of configurable circuits, memory elements are needed to control the transistors in the crossbar, consuming both area and power.

MEMS switches have been used for Radio Frequency (RF) switching applications which require very high frequency signals to be switched. However, conventional MEMS switches are known to potentially suffer from the problem of "stiction" which renders a switch remaining stuck closed due to molecular adhesion force. Depending on the application, the problem could be serious or critical. MEMS switches also are relatively slow compared to transistors when switching from one state to another.

BRIEF DESCRIPTION OF THE DRAWINGS

Embodiments of the present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Illustrative embodiments of the present invention include, but are not limited to crossbar devices constructed with MEMS switches.

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials, and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Further, various operations will be described as multiple discrete operations, in turn, in a manner that is most helpful in understanding the illustrative embodiments; however, the order of description should not be construed as to imply that these operations are necessarily order dependent. In particular, these operations need not be performed in the order of presentation.

The phrase "in one embodiment" is used repeatedly. The phrase generally does not refer to the same embodiment; however, it may. The terms "comprising," "having," and "including" are synonymous, unless the context dictates otherwise.

Figure 1:
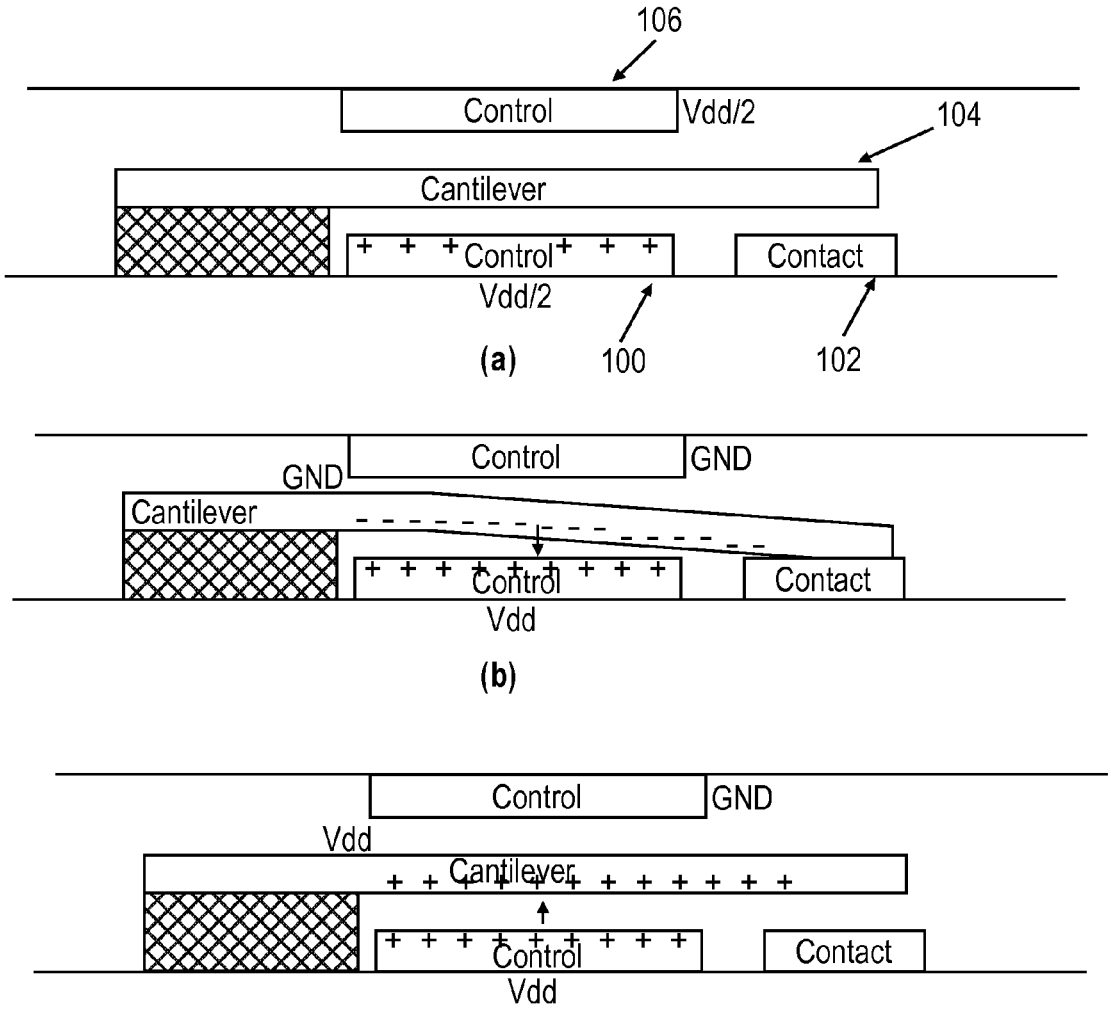
FIG. 1 illustrates operation of a SPST MEMS switch according to various embodiments.

FIGS. 1*a*-1*c* illustrate a Single Pole Single Throw (SPST) MEMS switch in accordance with various embodiments. As illustrated, a 4-terminal SPST MEMS switch may comprise: a first control node 100, a second control node 106, a contact node 102, and a cantilever 104, operatively coupled to each other as shown. Cantilever 104 may be constructed suspended in parallel to the surface of a chip, i.e. a substrate surface of an integrated circuit. Control nodes 100 and 106 may be configured to control the position of cantilever 104 to be either in contact with contact node 102 corresponding to a closed state or enabled state of the switch, or be away from contact node 102 corresponding to an open state or disenabled state of the switch.

In various embodiments, as shown in FIG. 1*a*), under normal operation the same voltage, which may be an intermediate voltage of $V_{dd}/2$, may be applied to control node 100 and control node 106. Thus, the voltage difference and resulting electrostatic forces between cantilever 104 and control node 100, and between cantilever 104 and control node 106 may be substantially the same regardless of the voltage on cantilever 104. Thus, the position of the cantilever 104 may not be changed and the state of the SPST MEMS switch may be maintained to be any previous state of the switch that may be either closed or open. In FIG. 1*b*), a voltage difference of $V_{dd}$ may be applied between control node 100 and control node 106 so that the electrostatic force on cantilever 104 may be large enough to change the position of cantilever 104 and thus the state of the SPST MEMS switch. In various embodiments, a voltage of $V_{dd}$ may be applied to control node 100, and a voltage of GND may be applied to control node 106, so applying a voltage of GND to cantilever 104 may cause an attractive electrostatic force that may move cantilever 104 to be in contact with the contact node 102. In various embodiments, cantilever 104 may be held in contact with contact node 102 by molecular adhesion forces even when the attractive electrostatic force is removed, which renders the state of the switch non-volatile. In FIG. 1*c*), a voltage of $V_{dd}$ may then be applied to control node 100 and a voltage of GND may be applied to control node 106, so applying a voltage of $V_{dd}$ to cantilever 104 may generate a repulsive electrostatic force and cantilever 104 may be pushed away from contact node 102.

In various embodiments, a 3-terminal SPST MEMS switch may have the same components as the earlier described 4-terminal SPST MEMS switch except that the 3-terminal SPST MEMS switch does not have control node 106 shown in FIGS. 1*a*-1*c*. The 3-terminal SPST MEMS switch may be operated in a similar manner, as the earlier described 4-terminal SPST MEMS switch.

Figure 2:
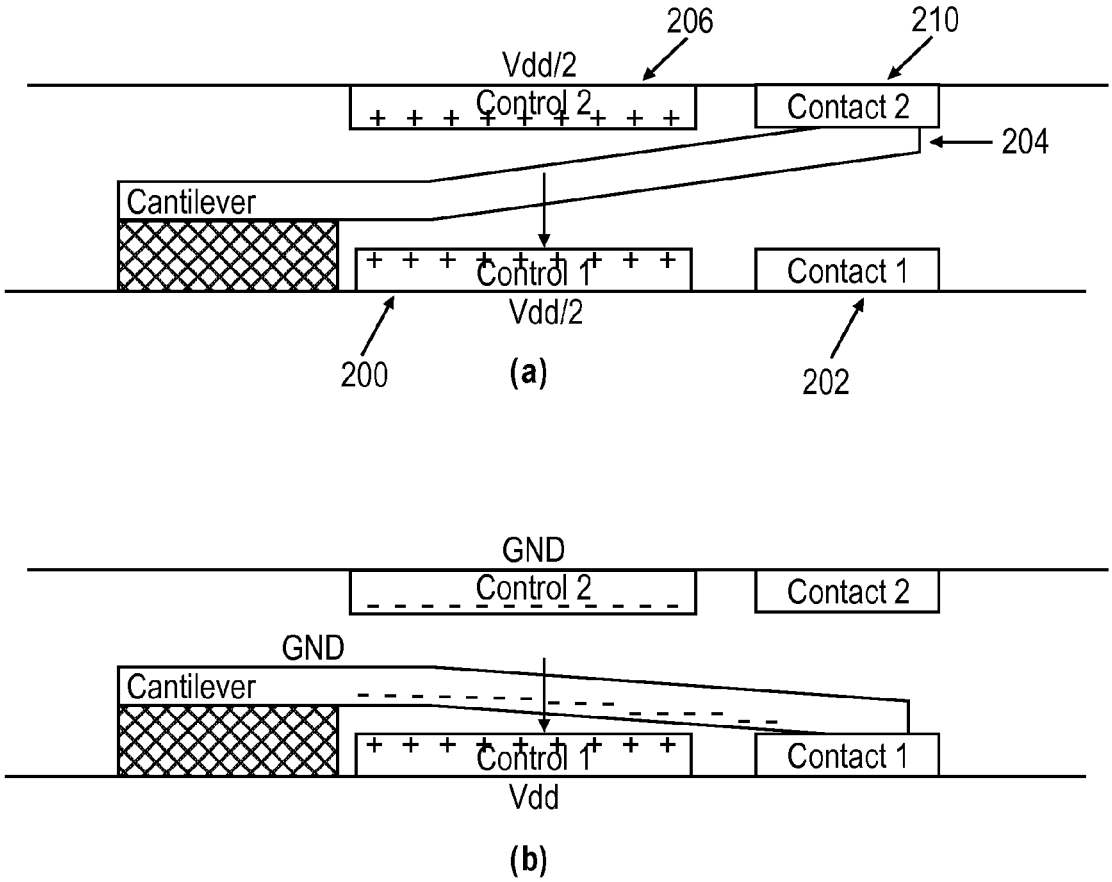
FIG. 2 illustrates operation of a SPDT MEMS switch according to various embodiments.

FIG. 2 illustrates a Single Pole Double Throw (SPDT) MEMS switch in accordance with various embodiments. As illustrated, a SPDT MEMS switch may comprise: a first control node 200 and a second control node 206, a first contact node 202 and a second contact node 210, and a cantilever 204, operatively coupled to each other as shown. And the SPDT MEMS switch may have three possible states: cantilever 204 being in contact with the first contact node 202 corresponding to a first closed state or enabled state of the switch, cantilever 204 being in contact with the second contact node 210 corresponding to a second closed state or enabled state of the switch, and cantilever 204 being away from both contact nodes corresponding to the open state or disenabled state of the switch. In various embodiments, the SPDT MEMS switch may only have two states with cantilever 204 being held in contact with either the first code 202 or second contact node 210.

In various embodiments, as illustrated in FIG. 2*a*), the shown state of the switch may correspond to cantilever 204 being in contact with contact node 210. The same voltage, which may be an intermediate voltage $V_{dd}/2$, may be applied to the first and second control nodes 200 and 206, so the voltage difference between cantilever 204 and either control node 200 or 206 may be substantially the same. Thus, regardless of the voltage applied to cantilever 204, the state of the SPDT MEMS switch may not be changed. In FIG. 2*b*), a voltage of $V_{dd}$ may be applied to control node 200, and a voltage of GND may be applied to cantilever 204 and control node 206, so the voltage difference between control node 200 and cantilever 204 is $V_{dd}$, and thus the electrostatic force may be large enough to attract cantilever 204 to be in contact with contact node 202. In various embodiments, cantilever 204 may be held in contact with contact node 202 by molecular adhesion force even when the electrostatic force is removed, which renders the state of the SPDT MEMS switch non-volatile. To change the state of the SPDT MEMS switch from the state shown in FIG. 2*b*) to the state shown in FIG. 2*a*), a voltage of $V_{dd}$ may be applied to control node 200 and cantilever 204, and a voltage of GND may be applied to control node 206, so the voltage difference between control node 206 and cantilever 204 is $V_{dd}$, and thus the electrostatic force may be large enough to attract cantilever 204 to be in contact with contact node 210. In various embodiments, cantilever 204 may be held in contact with contact node 210 by molecular adhesion force even when the electrostatic force is removed, which renders the state of the switch non-volatile.

Figure 3:
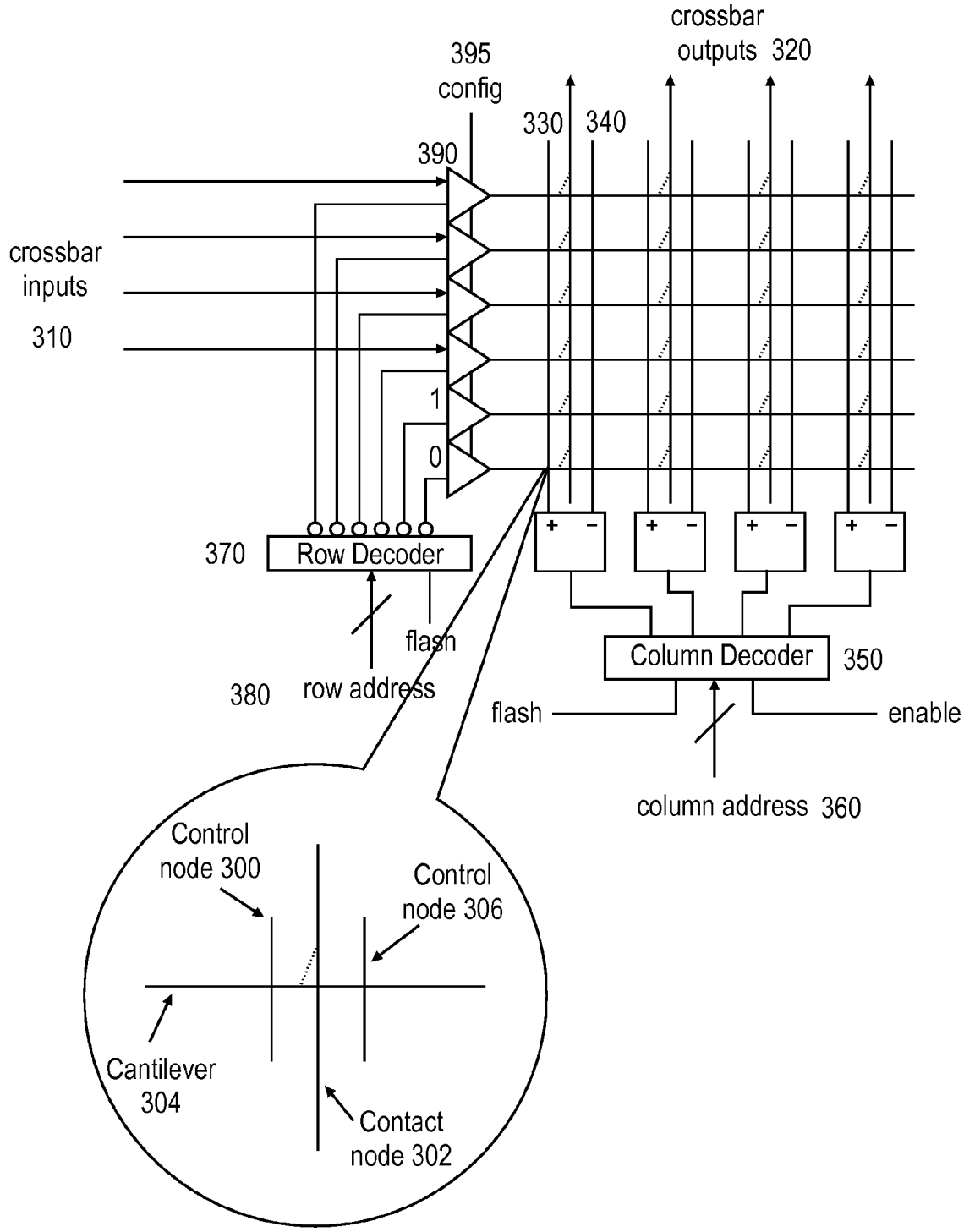
FIG. 3 illustrates a crossbar device constructed with MEMS switches according to various embodiments.

FIG. 3 shows a crossbar device employing an m×n array of MEMS switches, in accordance with various embodiments. M and N are any integer value. The magnified view in FIG. 3 shows a schematic view of a 4-terminal SPST MEMS switch as a cell of the m×n array, corresponding to the 4-terminal SPST MEMS device shown in FIG. 1. In various embodiments, 3-terminal SPST MEMS switches can also be used to construct the crossbar device.

As shown in FIG. 3, there are m input terminals 310, each of which may be coupled to cantilever nodes 304 of the switches in one of the m rows by means of an input multiplexer 390. There are n output terminals 320, each of which may be coupled to contact nodes 302 of the switches in one of the n columns. In various embodiments, there are also n first control lines 330, each of which may be coupled to the first control nodes 300 of the switches in one of the n columns. And there are n second control lines 340, each of which may be coupled to the second control nodes 306 of the switches in one of the n columns.

As shown in FIG. 3, the n columns may be configured by asserting a column address 360 on the input of a column decoder 350 to selectively enable one or more columns. In various embodiments, the first control lines 330 of the enabled columns may be set to $V_{dd}$ and the second control lines 340 of the enabled columns may be set to GND. In various embodiments, the control lines of the disenabled columns may be set to $V_{dd}/2$. Also as shown in FIG. 3, the m rows may be configured by asserting a row address 380 on the input of a row decoder 370, and asserting a configuration signal 395 on multiplexers 390 so that the outputs from row decoder 370 may be selected by multiplexer 390 as inputs coupled to cantilevers 304. And in various embodiments, only one of the m rows may be enabled with the input coupled to cantilever 304 of the enabled row being set to GND. In various embodiments the inputs coupled to cantilevers 304 of the disenabled rows may be set to Vdd. Thus, cantilevers 304 of the addressed switches located in both the enabled row and column may be attracted to contact nodes 302, and cantilevers 304 of the remaining switches of the enabled column may be repulsed away from contact nodes 302. In various embodiments, the entire switch array can be disenabled by asserting flash inputs to the decoders causing all columns to be enabled and all inputs to be set to Vdd.

In various embodiments, during operation of the crossbar device, configuration signal 395 may be de-asserted, thus crossbar inputs 310 coupled to input multiplexers 390 may be selected as inputs coupled to cantilevers 304. In various embodiments, during operation of the crossbar device, the control lines may be all set to the same voltage, which may be $V_{dd}/2$, to avoid any electrostatic force strong enough to cause cantilevers 304 to move away from the position programmed in the above recited configuration mode. In various embodiments, if the switch is programmed to be open, then the electrostatic force between cantilever 304 and the two control nodes may be approximately the same and cantilever 304 may remain away from contact node 302. In various embodiments, if the switch is programmed to be closed, the molecular adhesion force may keep cantilever 304 in contact with contact node 302. Thus when the switch is in the operational mode, the voltages on cantilever 304 and contact node 302 may vary without affecting the programming of the switches.

Figure 4:
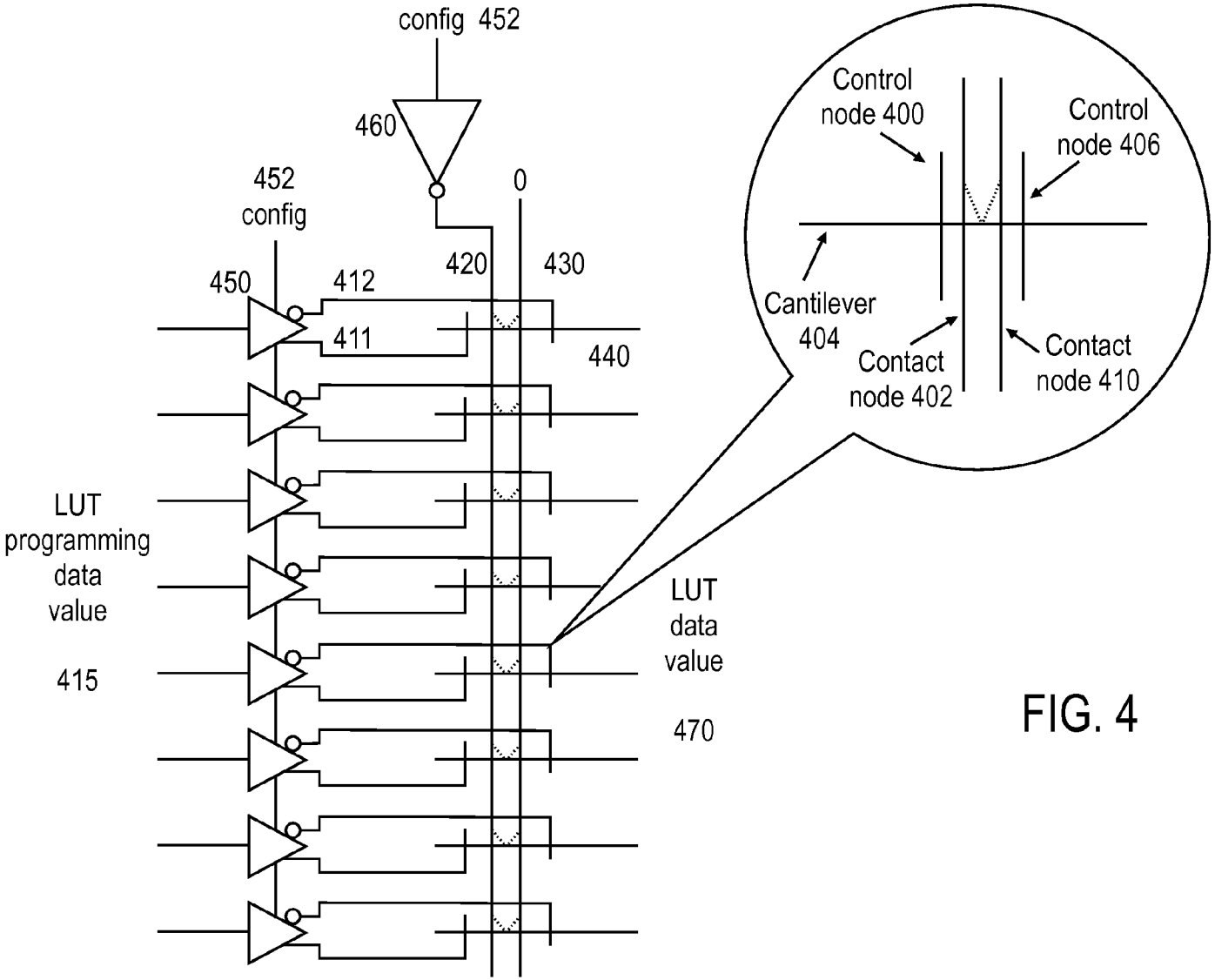
FIG. 4 illustrates a lookup table constructed with MEMS switches according to various embodiments.

In various embodiments, the SPDT MEMS switches can be used to construct efficient lookup tables (LUTs) in reconfigurable circuits. The magnified view in FIG. 4 shows a schematic view of a SPDT MEMS switch which corresponds to the SPDT MEMS device shown in FIG. 2. In various embodiments, the LUT may have m bits and there may be one switch for each bit of the LUT which provides logic 0 or 1 as required by the logic function being implemented. During operation of the LUT, the two contact nodes of the SPDT MEMS switches may be coupled to either $V_{dd}$ which represents logic 1 or GND which represents logic 0. And the SPDT MEMS switches may thus be configured to function as 2-input multiplexers to select and output either one of the logic values 1 and 0.

In various embodiments, as shown in FIG. 4, the first contact node 402 of the SPDT MEMS switches in the array may be coupled to the output of an inverter 460, the second contact node 410 of the SPDT MEMS switches may be constantly coupled to logic 0, and cantilevers 404 of the SPDT MEMS switches may be couple to the output terminals 470 of the LUT. Also as shown in FIG. 4, the input terminal of inverter 460 may be coupled to a configuration signal 452. In various embodiments, configuration signal 452 may also be asserted to enable m input buffers 450. In various embodiments, the two control nodes 400 and 406 of each of the m SPDT MEMS switches may be coupled to the true and complement signals 411 and 412 generated by one of the m input buffers 450. When configuration signal 452 is asserted as logic 1, input buffers 450 may be enabled to output the true and complement form 411 and 412 of input signals 415. In various embodiments, input signals 415 may comprise LUT programming data which may be used to program the m SPDT MEMS switches by attracting cantilevers 404 to contact one of the two contact nodes of the switches based at least on the logic functions being implemented. In various embodiments, when the LUT is being configured, the configuration signal 452 may be set to logic 1, thus the output of inverter 460 may be set to logic 0, and therefore both of the contact nodes of the m SPDT MEMS switches may be coupled to logic 0. Therefore, regardless of the position programmed, cantilever 404 may be coupled to logic 0.

In various embodiments, in the operational state of the LUT, configuration signal 452 may be set to logic 0, so input buffers 450 may be disenabled and both signals 411 and 412 may be set to the same voltage, which may be $V_{dd}/2$. In this operational state, the forces on cantilevers 404 may be balanced. And, the output of inverter 460 may thus be set to logic 1, and therefore the first contact node 402 of the switch may be coupled to logic 1 while the second contact node 410 may still be coupled to logic 0. In various embodiment, switches with cantilevers 404 programmed to be in contact with the first contact node 402, may output logic 1. In various embodiments, switches with cantilevers 404 programmed to be in contact with the second contact node 410, may output logic 0.

Reconfigurable circuits comprising crossbar switches as described, may contain millions of switches which may cause yield and reliability problems. Although MEMS switches can be very reliable, the failure of even one switch may render the entire chip unusable, for some applications. Providing a small amount of redundancy in the crossbar devices enables the faulty switches to be repaired by the crossbar devices themselves. In various embodiments, this repair can be done when the circuit is initially tested, or in the field using a self-test and repair procedure that is invisible to the user.

Figure 5:
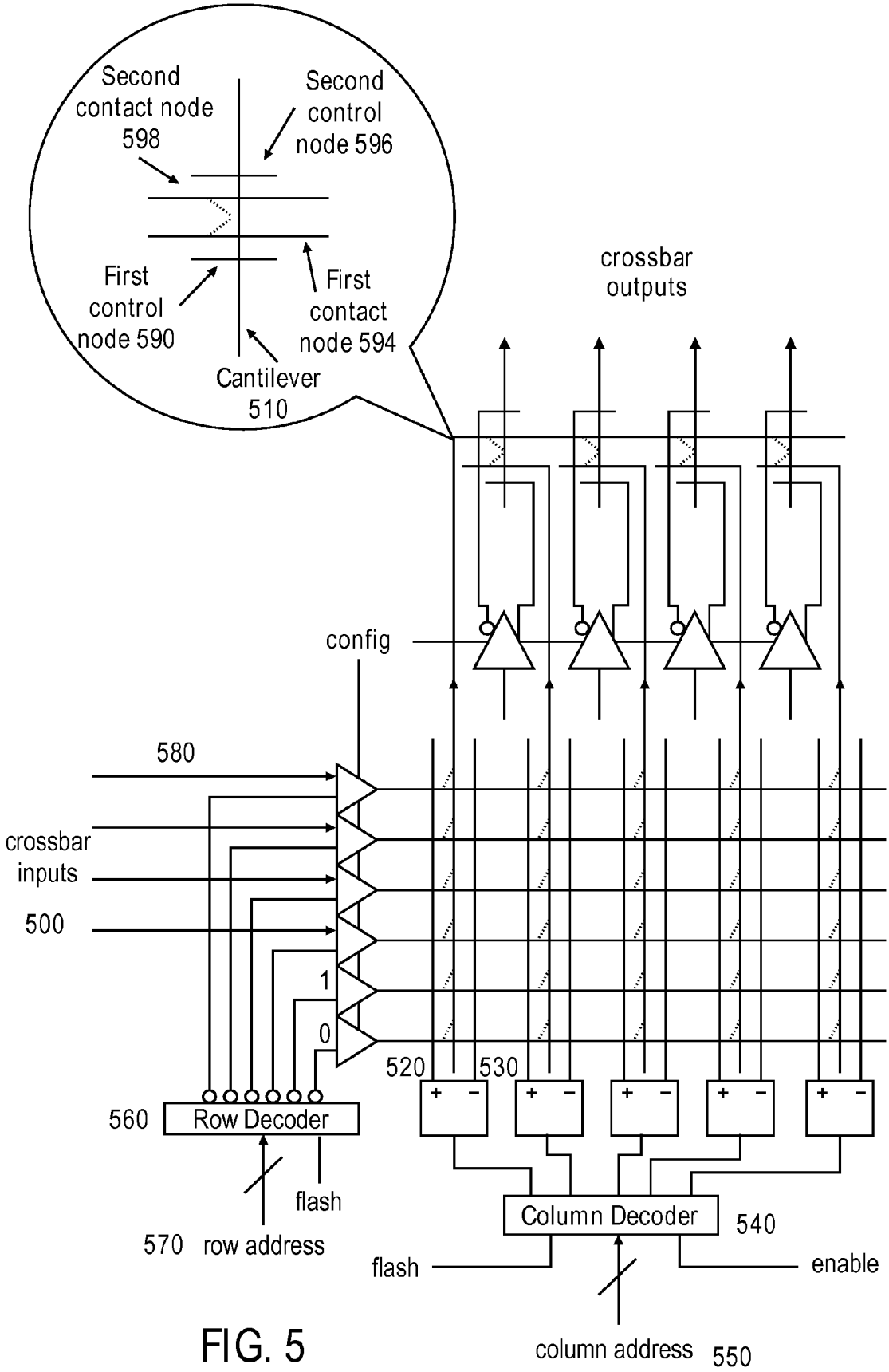
FIG. 5 illustrates a crossbar device constructed with MEMS switches and redundant circuitry according to various embodiments.

In various embodiments, FIG. 5 shows a crossbar device containing an m×n SPST MEMS switches array and redundancy circuitry including a spare column of SPST MEMS switches on the left-most side of the array and an additional row of SPDT MEMS switches on the top-most side of the array. This additional row of SPDT MEMS switches may be configured as described above, and the additional circuitry are not shown in FIG. 5 for the sake of clarity. In various embodiments, if a faulty switch is detected, the column containing the faulty switch may be replaced by the spare column by configuring the switches in the spare column in the same way as the faulty column. This may be accomplished by substituting the column address of the faulty column with the column address of the spare column during configuration. Further, the first contact nodes 594 of the additional row of SPDT MEMS switches may be respectively coupled to the n outputs of the crossbar device, and the second contact nodes 598 of the additional row of the SPDT MEMS switches may be all coupled to the output the spare column of SPST MEMS switches. And the first and second control nodes 590 and 596 of the SPDT MEMS switches in the additional row may be used to configure the SPDT MEMS switches so that when a SPST MEMS switch in one of the n columns fails, the corresponding SPDT MEMS switches may block the output of that faulty column and pass the output of the spare column instead.

Figure 6:
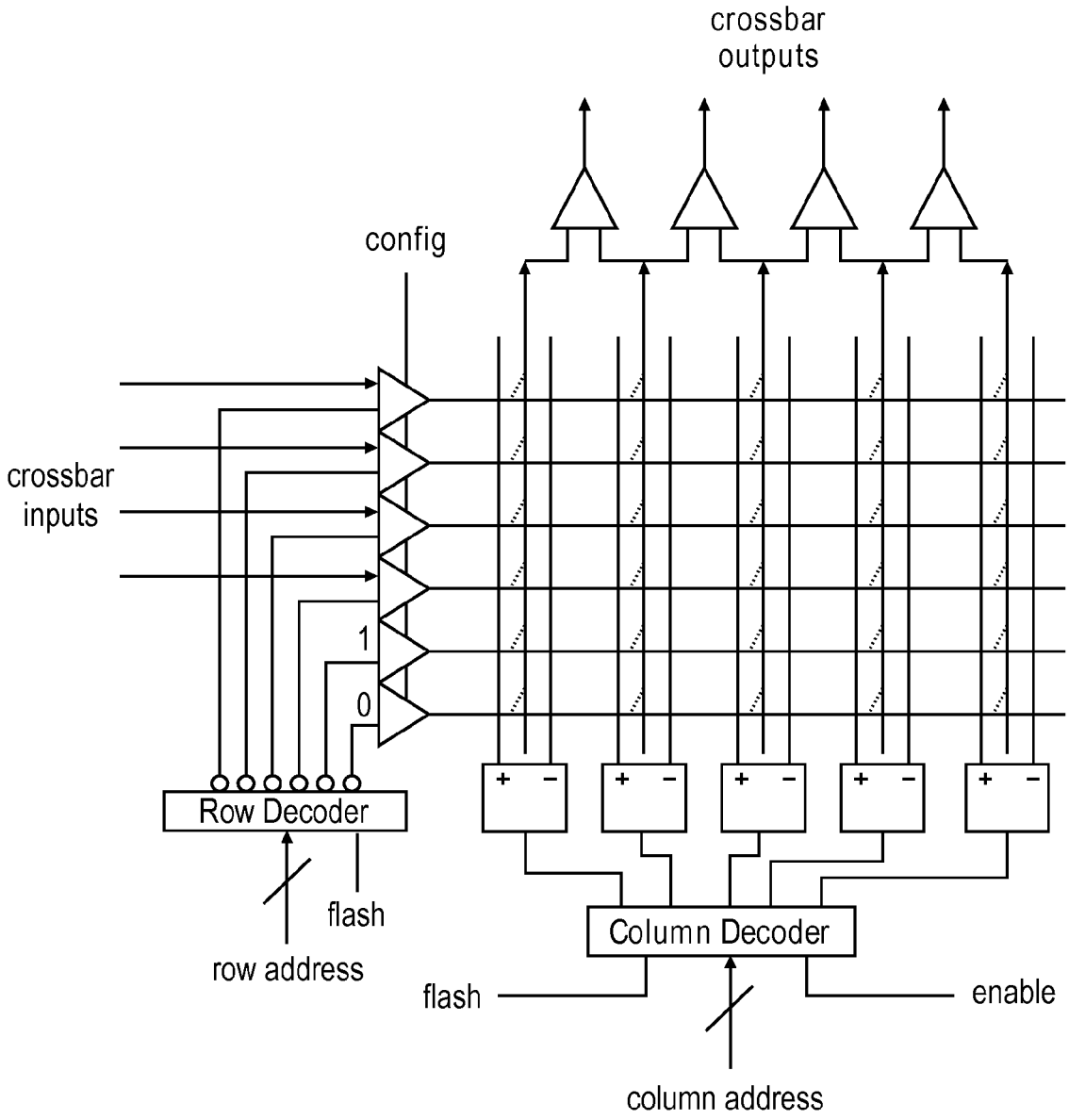
FIG. 6 illustrates another crossbar device constructed with MEMS switches and redundant circuitry according to various embodiments.
Figure 7:
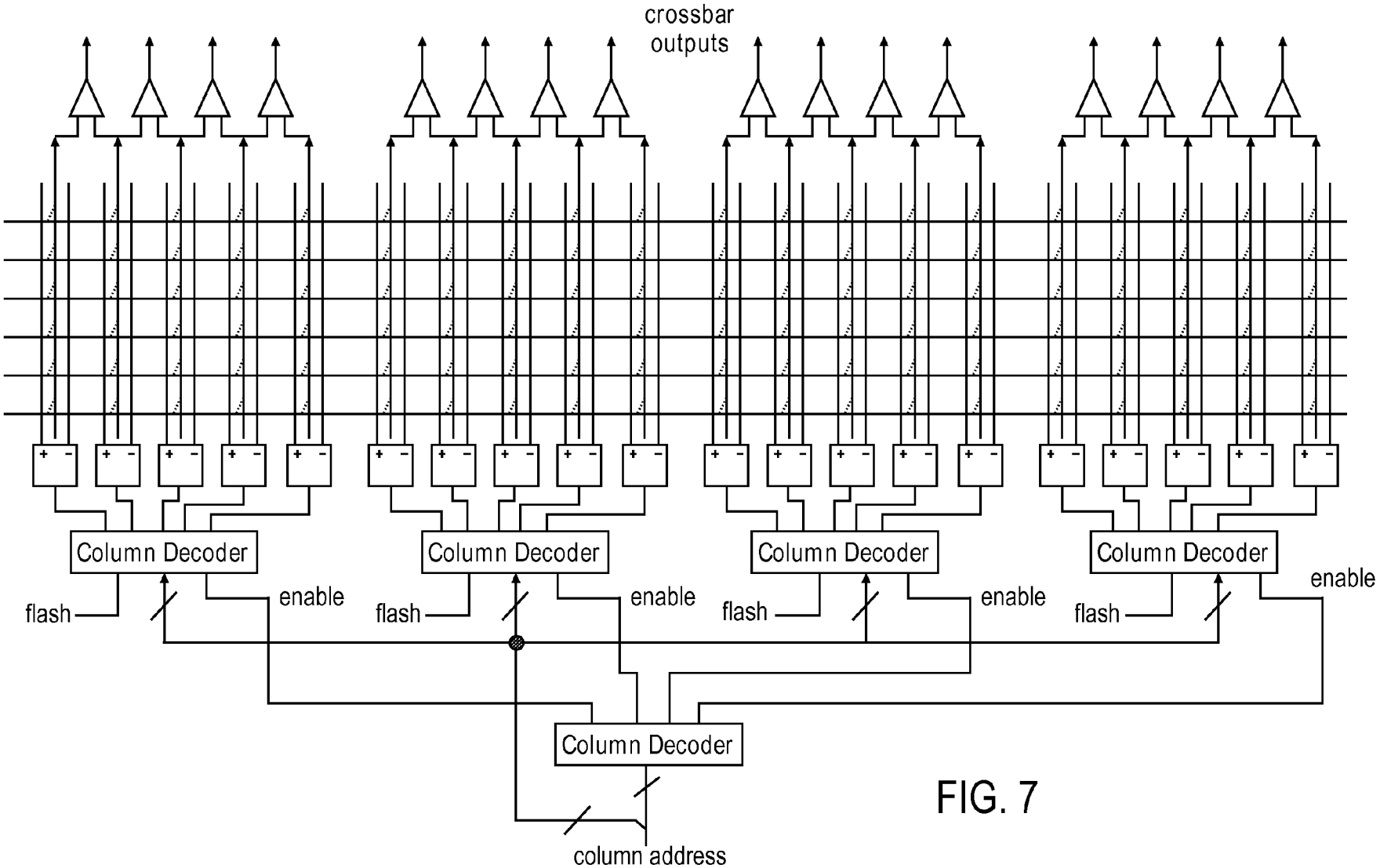
FIG. 7 illustrates a crossbar device constructed with MEMS switches and multiple redundant circuitries according to various embodiments.

In various embodiments, as shown in FIG. 6 there is not a particular spare column, rather any of the (n+1) columns of SPST MEMS switches may be used as the spare column. And as shown in FIG. 6, the additional row of SPDT MEMS switches at top-most side of the array may be used as 2-input multiplexers configured to decouple any column which may contain a failed switch from the outputs and replace the faulty column with any of the other n columns. In various embodiments, multiple spare columns may be provided in large switch arrays to accommodate multiple switch faults. This may be accomplished by partitioning the array into a plurality of sets of columns, with one spare column provided for each set as shown in FIG. 7.

In various embodiments, the MEMS switch arrays and the peripheral circuits controlling the programming and operation of the crossbar devices or the LUTs are compatible with CMOS process, which is more advantageous as compared to Flash or SRAM constructed crossbar devices or LUTs. In various embodiments, the cantilever of a MEM switch may be coupled to an external output terminal of device and the contact node coupled to an external input terminal of a device instead.

Although specific embodiments have been illustrated and described herein, it will be appreciated by those of ordinary skill in the art that a wide variety of alternate and/or equivalent implementations may be substituted for the specific embodiments shown and described, without departing from the scope of the embodiments of the present invention. This application is intended to cover any adaptations or variations of the embodiments discussed herein. Therefore, it is manifestly intended that the embodiments of the present invention be limited only by the claims and the equivalents thereof.

What is claimed is:

1. A crossbar device comprising:

m input terminals;

n output terminals;

n control lines; and a m×n Micro-Electro-Mechanical Systems (MEMS) switches array organized into m rows and n columns to couple the m input terminal to the n output terminals, each of the MEMS switches having a cantilever, a contact node, and a control node coupled to one of the n control lines to electrostatically control the cantilever to be in contact with the contact node or be away from the contact node using electrostatic attractive or repulsive force respectively;

wherein m and n are integers, and the cantilever and the contact node are configured to remain in contact by molecular adhesion force, after the cantilever has been electrostatically controlled to contact the contact node, and thereafter having the electrostatic force removed.

2. The crossbar device of claim 1, further comprising a row decoder configured to receive a row address, and to output based on the row address row enable signals to enable a row out of the m rows of the MEMS switches.

3. The crossbar device of claim 2, further comprising a column decoder configured to receive a column address, and to output based on the column address column enable signals to enable one or more columns out of the n columns of the MEMS switches.

4. The crossbar device of claim 3, further comprising m multiplexers configured to output the row enable signals or crossbar input signals responsively to a configuration signal.

5. The crossbar device of claim 1, further comprising n additional control lines correspondingly coupled to the n columns of MEMS switches;

wherein each of the MEMS switch further comprises another control node coupled to one of the n additional control lines to electrostatically control the cantilever to be in contact with the contact node or be away from the contact node using electrostatic attractive or repulsive force respectively.

6. The crossbar device of claim 1, wherein the cantilever of each MEMS switch is coupled to one of m input terminals, and the contact node of each MEMS switch is coupled to one of the n output terminals.

7. The crossbar device of claim 1, wherein the crossbar device comprises a p×q MEMS switch array comprising the m×n MEMS switch array, where p>m and q>n;

wherein the one or more additional columns of MEMS switches are configured to correspondingly backup one or more faulty ones of the n columns, and an additional row of MEMS switches are configured to selectively block outputs from the one or more faulty columns and pass outputs from the one or more corresponding additional columns.

8. The crossbar device of claim 7, wherein each of the additional MEMS switches comprises a second contact node;

a third contact node;

a second cantilever; and a second and a third control node correspondingly coupled to a second and a third of the control lines respectively, and configured to electrostically control the second cantilever to either contact the second or the third contact node, using electrostatic attractive or repulsive force;

wherein the second cantilever is configured to remain in contact with the second or the third contact node by molecular adhesion force after the second cantilever has been electrostatically controlled to contact the second or the third contact node, and thereafter having the electrostatic force removed.

9. A lookup table comprising:

a first input terminal;

a second input terminal;

m output terminals;

m first control lines;

m second control lines; and m Micro-Electro-Mechanical Systems (MEMS) switches organize into m rows to couple the first and second input terminals to the m output terminal, and wherein each of said MEMS switches comprises a first contact node;

a second contact node;

a cantilever;

a first control node coupled to one of the m first control lines;

a second control node coupled to one of the m second control lines;

wherein m is integer, the first and second control nodes are configured to electrostatically control the cantilever to be in contact with either the first contact node or the second contact node using electrostatic attractive or repulsive force, and the cantilever is configured to remain in contact with the first or second contact node by molecular adhesion force, after the cantilever has been electrostatically controlled to be in contact with the first or the second contact node and thereafter having the electrostatic force removed.

10. The lookup table of claim 9, further comprising m programming data lines; and m input buffers coupled to the m programming data lines and the m first and m second control lines, wherein the m input buffers are configured to receive programming data via the m programming data lines, and to output m pairs of true and complement signals to the m first and second control lines correspondingly.

11. The lookup table of claim 10, wherein the m input buffers are configured to be enabled by a configuration signal to generate the m pairs of true and complement signals.

12. The lookup table of claim 11, further comprising an inverter configured to receive the configuration signal and output to the first control line.

13. The lookup table of claim 9, wherein the first contact node is coupled to the first input terminal; the second contact node is coupled to the second input terminal; and the cantilever is coupled to one of the m output terminals.

14. A reconfigurable circuit comprising:

one or more function blocks; and a lookup table comprising a first input terminal;

a second input terminal;

m output terminals;

m first control lines;

m second control lines; and m Micro-Electro-Mechanical Systems (MEMS) switches organized into m rows to couple the first and second input terminals to the m output terminals;

wherein each of said MEMS switches comprises a first contact node, a second contact node, a cantilever, a first control node coupled to one of the m first control lines, and a second control node coupled to one of the m second control lines;

wherein m is an integer, the first and second control nodes are configured to electrostatically control the cantilever to be in contact with either the first contact node or the second contact node using electrostatic attractive or repulsive force, and the cantilever is configured to remain in contact with the first or second contact node by molecular adhesion force, after the cantilever has been electrostatically controlled to be in contact with the first or the second contact node and thereafter having the electrostatic force removed.

15. The reconfigurable circuit of claim 14, wherein the look up table further comprising m programming data lines; and m input buffers coupled to the m programming data lines and the m first and m second control lines, wherein the m input buffers are configured to receive programming data via the m programming data lines, and to output m pairs of true and complement signals to the m first and second control lines correspondingly.

16. A reconfigurable circuit comprising:

one or more function blocks; and a crossbar comprising m input terminals;

n output terminals;

n control lines; and a m×n Micro-Electro-Mechanical Systems (MEMS) switches array organized into m rows and n columns to couple the m input terminals to the n output terminals, and each of the MEMS switches comprises a cantilever, a contact node, and a control node coupled to one of the n control lines to electrostatically control the cantilever to be in contact with the contact node or be away from the contact node using electrostatic attractive or repulsive force respectively;

wherein m and n are integers, and the cantilever and the contact node are configured to remain in contact by molecular adhesion force, after the cantilever has been electrostatically controlled to contact the contact node, and thereafter having the electrostatic force removed.

17. The reconfigurable circuit of claim 16, wherein the crossbar comprises a>m×>n MEMS switch array comprising the m×n MEMS switch array; and wherein the one or more additional columns of MEMS switches are configured to correspondingly backup one or more faulty columns out of the n columns; and wherein a row of additional MEMS switches are configured to selectively block outputs from the one or more faulty columns and pass outputs from the one or more corresponding additional columns.

18. A Micro-Electro-Mechanical Systems (MEMS) switch, comprising:

a first contact node configured to be coupled to a first external terminal;

a second contact node configured to be coupled to a second external terminal;

a cantilever configured to be coupled to a third external terminal;

a first control node configured to be coupled to a first external control line;

a second control node configured to be coupled to a second external control line;

wherein the first and second control nodes are configured to electrostatically control the cantilever to be in contact with either the first contact node or the second contact node using electrostatic attractive or repulsive force, and the cantilever is configured to remain in contact with the first or second contact node by molecular adhesion force, after the cantilever has been electrostatically controlled to be in contact with the first or the second contact node and the electrostatic force has been removed.

* * * * *